US010494849B2

(12) United States Patent
Lambertini

(10) Patent No.: US 10,494,849 B2
(45) Date of Patent: Dec. 3, 2019

(54) HINGE FOR DOORS OR WINDOWS

(71) Applicant: GSG INTERNATIONAL S.P.A., Budrio (BO) (IT)

(72) Inventor: Marco Lambertini, San Lazzaro di Savena (IT)

(73) Assignee: GSG INTERNATIONAL S.P.A., Budrio (IT)

( * ) Notice: Subject to any disclaimer, the term of this patent is extended or adjusted under 35 U.S.C. 154(b) by 195 days.

(21) Appl. No.: 15/549,454

(22) PCT Filed: Feb. 10, 2016

(86) PCT No.: PCT/IB2016/050694
§ 371 (c)(1),
(2) Date: Aug. 8, 2017

(87) PCT Pub. No.: WO2016/128904
PCT Pub. Date: Aug. 18, 2016

(65) Prior Publication Data

US 2018/0002963 A1 Jan. 4, 2018

(30) Foreign Application Priority Data

Feb. 11, 2015 (IT) ..... BO2015A0056

(51) Int. Cl.
*E05D 15/52* (2006.01)
*E05D 7/00* (2006.01)
*E05D 3/18* (2006.01)

(52) U.S. Cl.
CPC ..... *E05D 15/5211* (2013.01); *E05D 3/18* (2013.01); *E05D 7/0054* (2013.01);
(Continued)

(58) Field of Classification Search
CPC .. E05D 3/14; E05D 3/18; E05D 3/186; E05D 7/0054; E05D 7/0009; E05D 7/0018;
(Continued)

(56) References Cited

U.S. PATENT DOCUMENTS 5,794,310 A * 8/1998 Dallmann ..... E05D 7/0415 16/235
5,964,011 A * 10/1999 Ruston ..... E05D 7/0054 16/239

(Continued)

FOREIGN PATENT DOCUMENTS

DE 9001629 * 4/1990
DE 9001629 U1 4/1990

(Continued)

*Primary Examiner* — Emily M Morgan
(74) *Attorney, Agent, or Firm* — Pearne & Gordon LLP

(57) ABSTRACT

Described is a hinge for doors or windows comprising: a first fixed body (5) associated with a fixed frame (1) and having a first axis (X1) of fixed articulation and a slot (6) made parallel to the axis (XC) of longitudinal extension of the first fixed body (5); a second movable body (7) connected to a movable sash (2); a first lever (8) having a first end articulated to the first fixed body (5) about the first axis (X1) of fixed articulation, a second end articulated to the second movable body (7), defining a second axis (X2) of articulation, and an intermediate zone; a second lever (9) having a first end articulated inside the slot (6) of the first fixed body (5) to define a third slidable axis (X3) of articulation, a second end articulated to the second movable body (7) defining a fourth axis (X4) of articulation and an intermediate zone; the first (8) and the second (9) levers are articulated to each other in the corresponding intermediate zone to define a fifth axis (X5) of shared articulation; means (10, 11) for adjusting at least one between the first axis (X1) of articulation and the third slidable axis (X3) of articulation along at least a first horizontal axis (XR1) parallel to the axis (Continued)

(XC) of longitudinal extension of the first fixed body (5) or a second horizontal axis (XR2) perpendicular to the axis (XC) of longitudinal extension of the first fixed body (5); the adjustment means (10) comprising a slide (12) positioned on the first fixed body (1) and having a first constraining portion for the first axis (X1) of articulation and a second portion connected to an adjustment axis (X12), parallel to the first axis (X1) of articulation, using a rotary element (13) configured for moving the slide (12), in both directions and along the first horizontal axis (XR1), in such a way as to vary the distance (D) between the adjustment axis (X12) and the first axis (X1) of articulation along the first horizontal axis (XR1), in both directions.

11 Claims, 8 Drawing Sheets

(52) U.S. Cl.
CPC ..... *E05D 15/5214* (2013.01); *E05Y 2600/31* (2013.01); *E05Y 2600/312* (2013.01); *E05Y 2900/132* (2013.01); *E05Y 2900/148* (2013.01)

(58) Field of Classification Search
CPC ..... E05D 7/06; E05D 2007/0461; E05D 2015/487; E05D 2015/485; E05D 15/26; E05D 15/48; E05D 15/14; E05C 17/32
USPC ..... 16/362, 364, 366, 370
See application file for complete search history.

(56) References Cited

U.S. PATENT DOCUMENTS

| | | | | |
|---|---|---|---|---|
| 10,072,450 | B2 * | 9/2018 | Lambertini | E05D 7/0054 |
| 2005/0055804 | A1 * | 3/2005 | Liang | E05D 7/0415 16/235 |
| 2008/0307606 | A1 * | 12/2008 | Karlsson | E05D 7/0415 16/243 |
| 2011/0131763 | A1 * | 6/2011 | La See | E05D 15/30 16/364 |
| 2013/0198997 | A1 * | 8/2013 | Olson | E05D 15/30 16/364 |

FOREIGN PATENT DOCUMENTS

| | | | |
|---|---|---|---|
| DE | 202012008225 | U1 | 12/2013 |
| EP | 0385414 | A1 | 2/1990 |
| EP | 2085553 | A2 | 8/2009 |
| EP | 2740872 | A2 | 6/2014 |

* cited by examiner

Fig.9
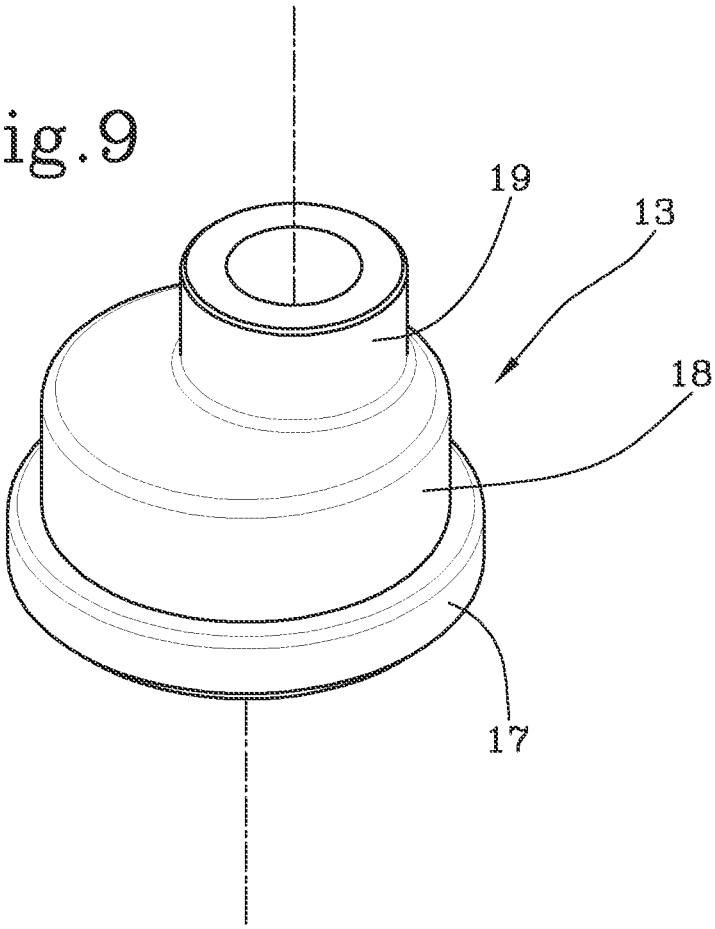
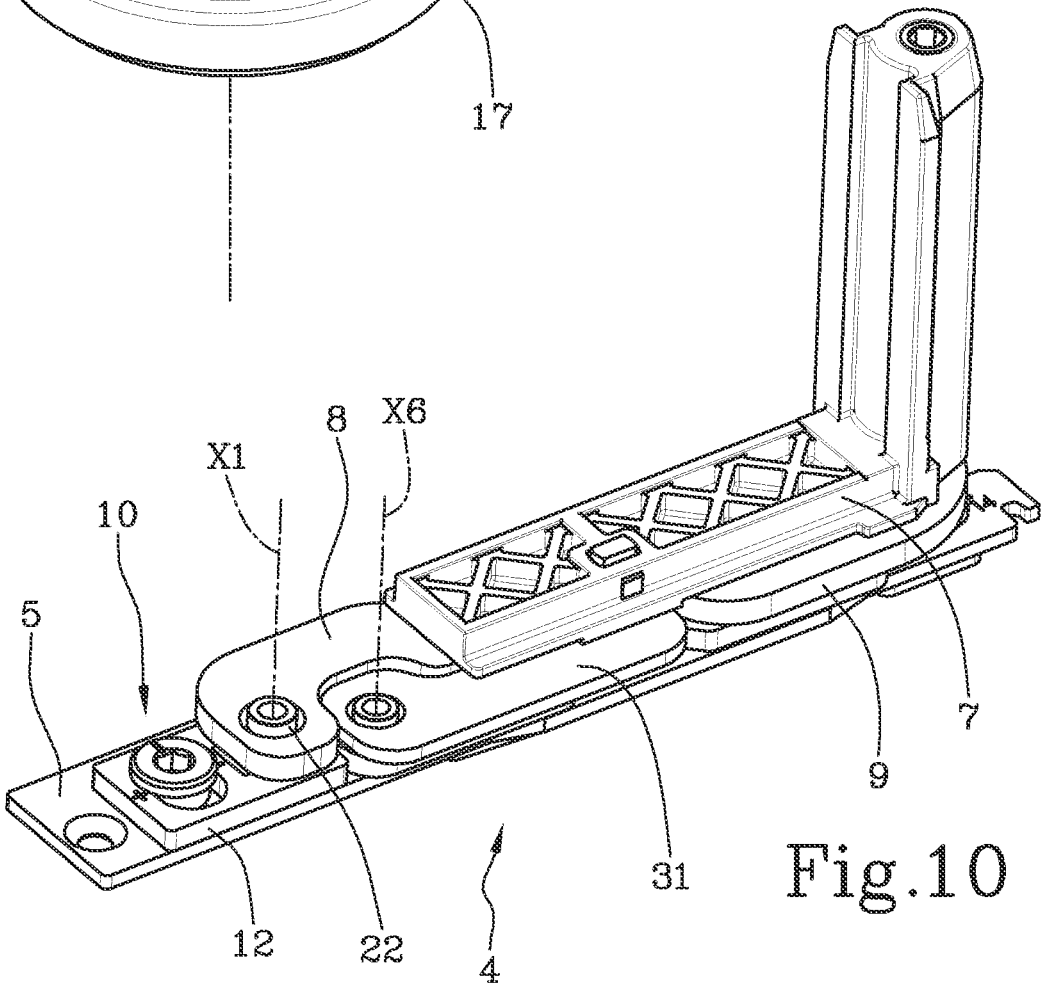
Fig.10

HINGE FOR DOORS OR WINDOWS

TECHNICAL FIELD

This invention relates to a hinge for doors or windows.

More specifically, the hinge for doors or windows to which reference is made is the so-called "concealed" hinge, that is to say, a model of hinge which, with the door or window mounted, is not visible on the front of the closed door or window, whilst it is only partly visible (the portion of structure fixed to the fixed frame) with the door or window open.

This type of hinge is applied, according to this invention, on doors or windows comprising a fixed frame and a movable sash formed with components made of metal, PVC or PVC-wood, having a profile with at least one perimeter channel for fastening the operating and opening/closing accessories of the door or window including, precisely, the concealed hinge.

BACKGROUND ART

Hinges of this kind are structured to be able to open the doors or windows with a traditional, turning opening, or with tilt and turn openings.

This type of hinge basically comprises:

- a first fixed body associated with the fixed frame (in the proximity of a corner joint) having a first axis of articulation and a slot made parallel to the longitudinal axis of extension of the first fixed body;
- a second movable body connected to the sash (in particular in the lower zone of the corner)
- a first lever having a first end articulated to the first fixed body about the first axis of articulation, a second end articulated to the second body (defining a second axis of articulation) and an intermediate zone;
- a second lever having a first end articulated inside the slot of the first body (defining a third roto-translational axis of articulation), a second end articulated to the second body (defining a fourth axis of articulation) and an intermediate zone;
- the first and the second lever are articulated to each other in the corresponding intermediate zone (intersection) to define a fifth axis of articulation.

To make the angle of opening the sash relative to the frame greater than a right angle (preferably up to a flat angle) a connecting rod mechanism is added to the hinge interposed and articulated, for example, between the second end of the second lever and the second movable body.

The connecting rod is articulated at its first end to the second end of the second lever and, at the opposite end, to the second movable body.

A prior art solution of a lower hinge of this kind is described in patent document EP 385.414.

In order to expand the use of this type of hinge to the above-mentioned types of doors and windows (with profiled sections) it has been necessary to study systems for adjusting the position of the movable sash relative to the fixed frame on more axes to optimise the assembly, make the movement of the sash correct and free of undesired contacts with the fixed frame and also the closing seal of the sash on the fixed frame.

It should be noted that there are basically at least three types of adjustment which should provided on the movable sash:

- height of the movable sash relative to the fixed frame by adjusting along a vertical axis;

- centring of the sash relative to the frame, that is, along a first horizontal axis parallel to the crosspieces of the movable sash and the frame;
- compression of the sash relative to the fixed frame, that is to say, moving the movable sash towards and away from the fixed frame (in the closed configuration) for also varying the compression of the seals present, by adjusting along a second horizontal axis transversal to the first centring axis.

Now, as regards systems or adjustment units relating to the vertical axis, the prior art solutions comprise threaded adjustment elements positioned on the second movable body and configured to interact between the second body and the movable sash (connected to the second body) for modifying the position in height of the sash relative to the second movable body.

A unit for adjusting the compression is known and illustrated in patent document EP2740872A2.

In this solution, the hinge has threaded adjustment elements positioned on the second body connected to the movable sash and configured to guarantee a translational movement along the above-mentioned second axis in both directions of the movable sash relative to the second movable body. This type of adjustment is preferably combined with the system for adjusting the height of the second movable body.

A unit for adjusting the first horizontal axis to obtain a centring of the movable sash relative to the fixed frame is known from patent document EP2085553A2.

This solution uses, again, the second movable body connected to the sash and composed of a horizontal base connected to one of the levers and guided in a translation fashion relative to the sash and a part stably associated with the movable sash. The adjustment unit is connected to the base and allows a translation of the horizontal side along the relative longitudinal direction. In this way, the position of the axis of articulation of the lever connected to the horizontal base along the above-mentioned first horizontal axis is adjusted.

However, the adjustment units illustrated up to now, in particular those units acting on the first and second horizontal axis of particular interest in this description, have drawbacks.

The application of these adjustment units on the second movable body results in a complex structure made up of several parts (not a single-block) generating a reduced stability of the parts which, over time, can reduce the functionality of the sash itself and the precision in the corresponding adjustments.

Also, the adjustment devices structured in this way on the second body may be handled for the adjustment the with extreme difficulty in the case of a door or a window positioned at a low height above a treadable surface.

DISCLOSURE OF THE INVENTION

The aim of this invention is to provide a hinge for doors or windows, in particular a concealed hinge, which overcomes the above-mentioned drawbacks of the prior art.

More specifically, the aim of this invention is to provide a hinge for doors or windows which can adjust the movable sash in at least one of the horizontal axes in a precise, quick and easy fashion.

A further aim of this invention is to provide a hinge for doors or windows which can adjust the movable sash in at least one of the horizontal axes while maintaining its compact, precise and reliable structure over time. These aims are fulfilled by the hinges for doors or windows according to this invention having the features described in the appended claims.

More specifically, the hinge can be used for doors or windows comprising a fixed frame and a movable sash formed by section bars having at least one perimeter channel.

The hinge comprises a first fixed body associated with the fixed frame. The first fixed body has a first fixed articulation axis and a slot made parallel to the longitudinal axis of extension of the first fixed body.

The hinge also comprises a second movable body connected to the movable sash.

Again, the hinge comprises a first lever having a first end articulated to the first fixed body about the first axis of fixed articulation, a second end articulated to the second movable body, defining a second axis of articulation, and an intermediate zone.

Also, the hinge comprises a second lever having a first end articulated inside the slot of the first fixed body for defining a third slidable axis of articulation, a second end articulated to the second movable body defining a fourth axis of articulation and an intermediate zone. The first and the second lever are articulated to each other in the corresponding intermediate zone to define a fifth shared axis of articulation.

The hinge also comprises means for adjusting at least one between the first axis of articulation or third axis of articulation along at least a first horizontal axis parallel to the axis of longitudinal extension of the first fixed body or along a second horizontal axis perpendicular to the axis of longitudinal extension of the first fixed body.

According to the invention, the adjustment means comprise a slide positioned on the first fixed body and having a first constraining portion for the first axis of articulation and a second portion connected to an adjustment axis, parallel to the first axis of articulation, using a rotary element configured for moving the slide, in both directions and along the first horizontal axis, in such a way as to vary the distance between the adjustment axis and the first axis of articulation along the first horizontal axis, in both directions.

Thanks to these adjustment means it is possible to obtain a precise and secure centring adjustment of the movable sash relative to the fixed frame thanks to the adjustment connection on the fixed articulation point of the lever.

BRIEF DESCRIPTION OF DRAWINGS

This and other features of the invention will become more apparent from the following detailed description of a preferred, non-limiting example embodiment of it, with reference to the accompanying drawings, in which:

FIG. 9 illustrates a perspective view of an eccentric rotary element forming part of means for adjusting the hinge of the previous drawings;

FIG. 10 illustrates a perspective view, with some parts cut away to better illustrate others, of the hinge for doors or windows of FIG. 1 in a closed operating configuration of the sash;

DETAILED DESCRIPTION OF PREFERRED EMBODIMENTS OF THE INVENTION

Figure 1:
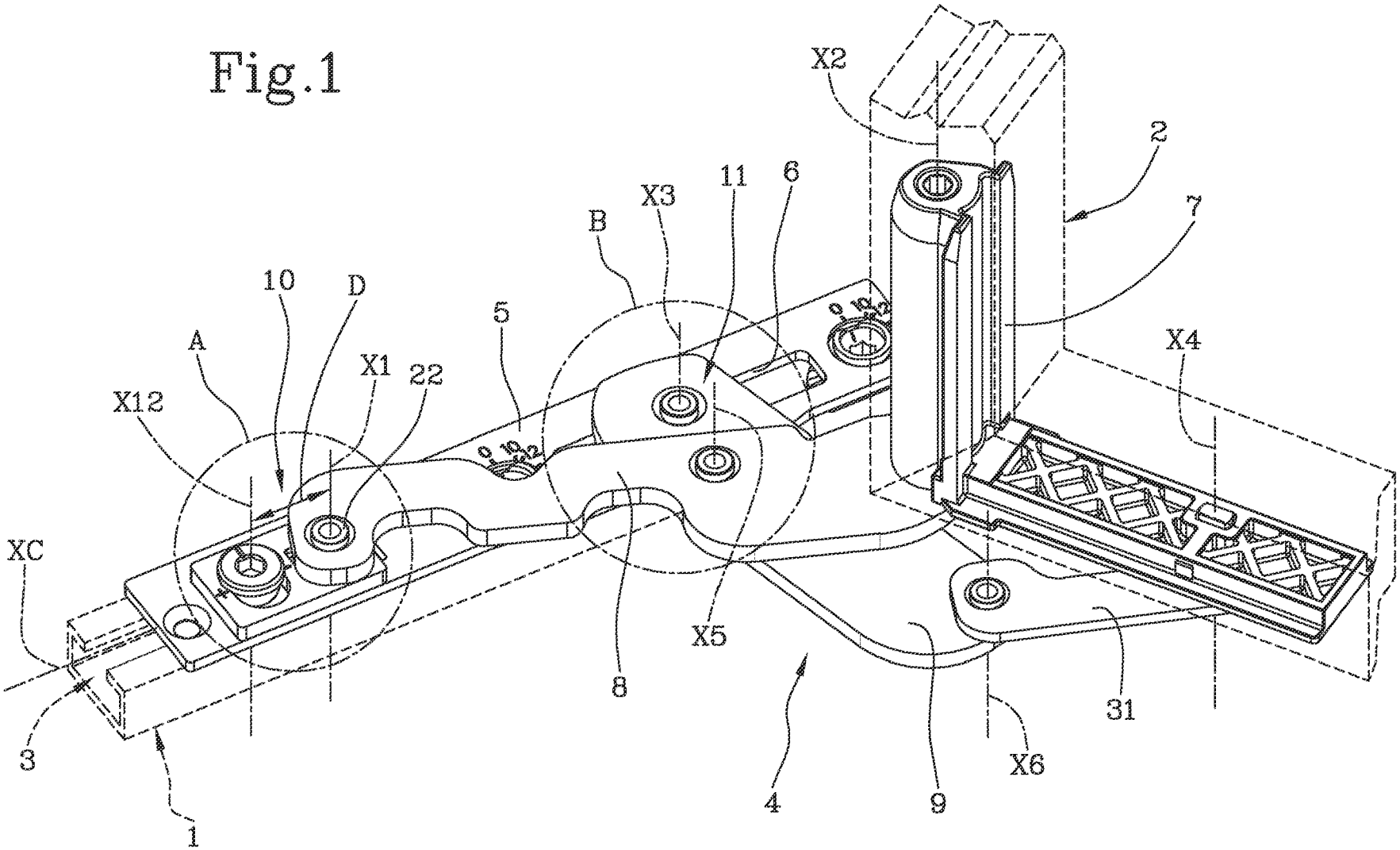
FIG. 1 illustrates a perspective view, with some parts cut away to better illustrate others, of a hinge for doors or windows, according to this invention, applied to a fixed frame and movable sash, in an open operating configuration of the sash.

With reference to the accompanying drawings, in particular with reference to FIG. 1, the numeral 4 denotes a hinge for doors or windows.

More specifically, the hinge 4 according to this invention is of the "concealed" type, that is, a hinge which, with the door or window mounted, is not visible on the front of the closed door or window, whilst it is only partly visible with the door or window open.

It should be noted that this type of hinge 4 may be used for doors or windows with traditional, turning opening action, or a tilt and turn, without thereby limiting the scope of protection of this invention.

This hinge 4 is applied to doors or windows comprising a fixed frame 1 and a movable sash 2 formed by section bars having at least one perimeter channel 3.

The fixed frame 1 and the movable sash are only illustrated schematically and partly in the accompanying drawings.

The hinge 4 comprises (see FIGS. 1 and 10) a first fixed body 5 associated with the fixed frame 1.

The first fixed body 5 has a first axis X1 of fixed articulation and a slot 6 made parallel to an axis XC of longitudinal extension of the first fixed body 5.

The hinge 4 comprises a second movable body 7 connected to the movable sash 2.

Moreover, the hinge 4 comprises a first lever 8 having a first end articulated to the first fixed body 5 about the first axis X1 of fixed articulation, a second end articulated to the second movable body 7, defining a second axis X2 of articulation, and an intermediate zone.

The hinge 4 comprises a second lever 9 having a first end articulated inside the slot 6 of the first fixed body 5 for defining a third slidable axis X3 of articulation, a second end articulated to the second movable body 7 defining a fourth axis X4 of articulation and an intermediate zone.

The first and second lever 8 and 9 are articulated to each other in the corresponding intermediate zone to define a fifth axis X5 of shared articulation.

Also, the hinge 4 comprises means 10 or 11 for adjusting at least one between the first axis X1 of articulation or the third axis X3 of articulation along at least a first horizontal axis XR1 parallel to the axis XC of longitudinal extension of the first fixed body 5 or along a second horizontal axis XR2 perpendicular to the axis XC of longitudinal extension of the first fixed body 5.

According to the invention, the adjustment means 10 comprise a slide 12 positioned on the first fixed body 5 and having a first constraining portion for the first axis X1 of articulation and a second portion connected to an adjustment axis X12, parallel to the first axis X1 of articulation, using a rotary element 13 configured for moving the slide 12, in both directions and along the first horizontal axis XR1, in such a way as to vary the distance between the adjustment axis X12 and the first axis X1 of articulation along the first horizontal axis XR1, in both directions.

It should be noted that these adjustment means 10 operate on the first axis X1 of fixed articulation and allow a modification of the position of the group of levers 8 and 9 and hence the sash 2 along the first horizontal axis XR1 for adjusting axially, that is, centring the movable sash 2 relative to the fixed frame 1.

Preferably, the hinge 4 also comprises a connecting rod 31 having a first end and a second end.

The connecting rod 31 is interposed and articulated, at its first end to the second end of the second lever 9 and, at its second end, to the second movable body 2.

It should be noted that the fourth axis X4 of articulation is defined between the second movable body 7 and the second end of the connecting rod 31. The articulation between the first end of the connecting rod 31 and the end of the second lever 9 define a sixth axis X6 of articulation.

Preferably, the first fixed body 5 comprises a flat plate with a mainly longitudinal extension which can be fixed, with fastening means not illustrated, on the upper part of the channel 3 of the fixed frame 1. Preferably, the second movable body 7 comprises a corner element associated with a corresponding corner portion (in this case, below) of the sash 2.

Preferably, the first fixed body 5 has the first axis X1 of articulation (a through hole) made on a relative part distal with respect to a corner portion of the fixed frame 1.

It should be noted that the first fixed body 5 has the longitudinal slot 6 made on a part close to the corner portion of the fixed frame 1.

Preferably, the adjustment means 10 have the first portion of the slide 12 equipped with a projecting body 14 slidably coupled in a slot 15 made on the first fixed body 5.

Figure 5:
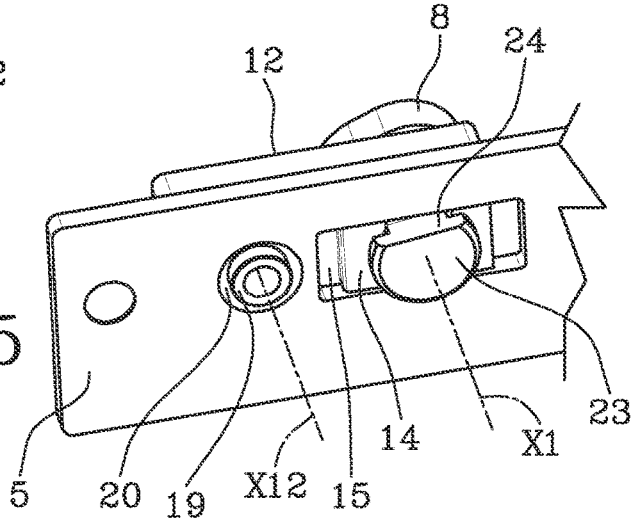
FIG. 5 illustrates a perspective view from below of the detail A of the hinge of FIG. 1.
Figure 6:
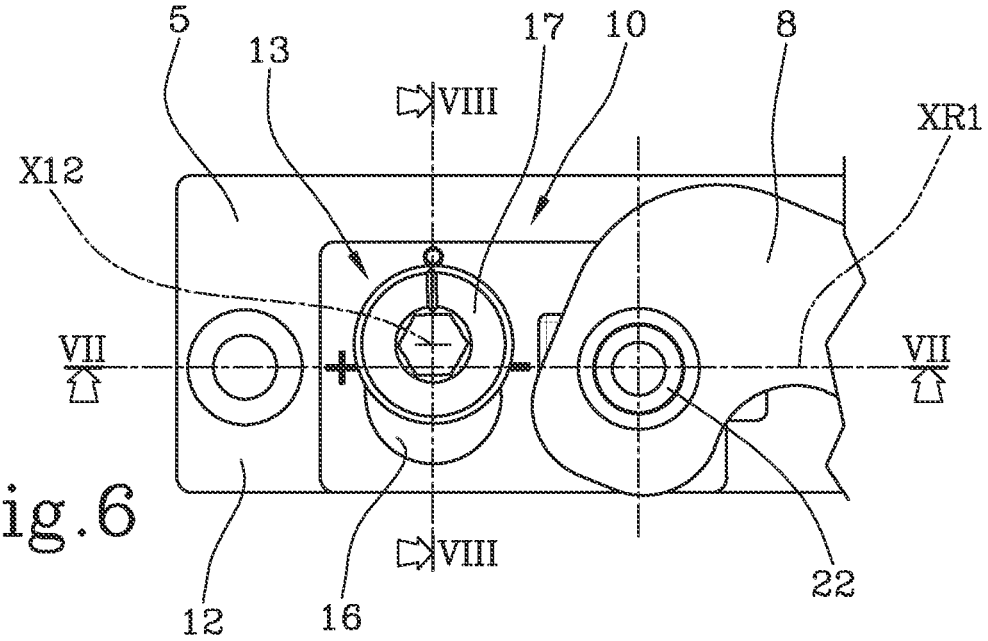
FIG. 6 illustrates a perspective plan view from above of the detail A of the hinge of FIG. 1.
Figure 7:
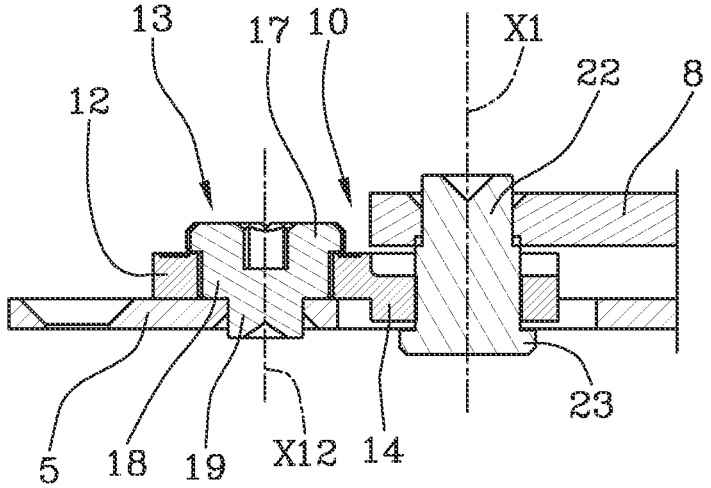
FIG. 7 illustrates a cross section through line VII-VII of FIG. 6.
Figure 8:
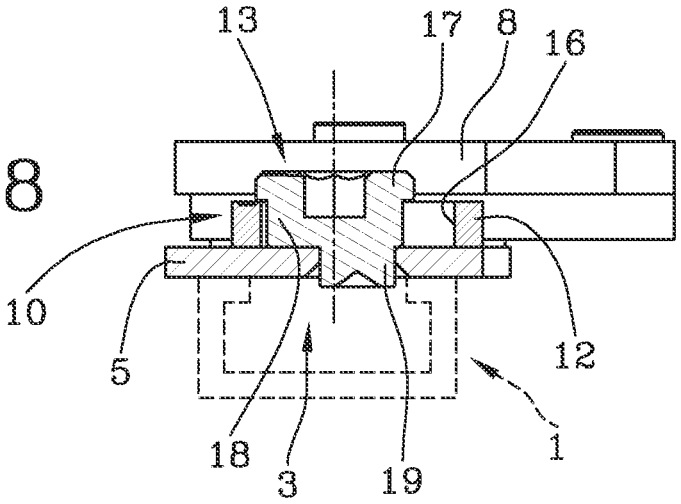
FIG. 8 illustrates a cross section through line VIII-VIII of FIG. 6.
Figure 11:
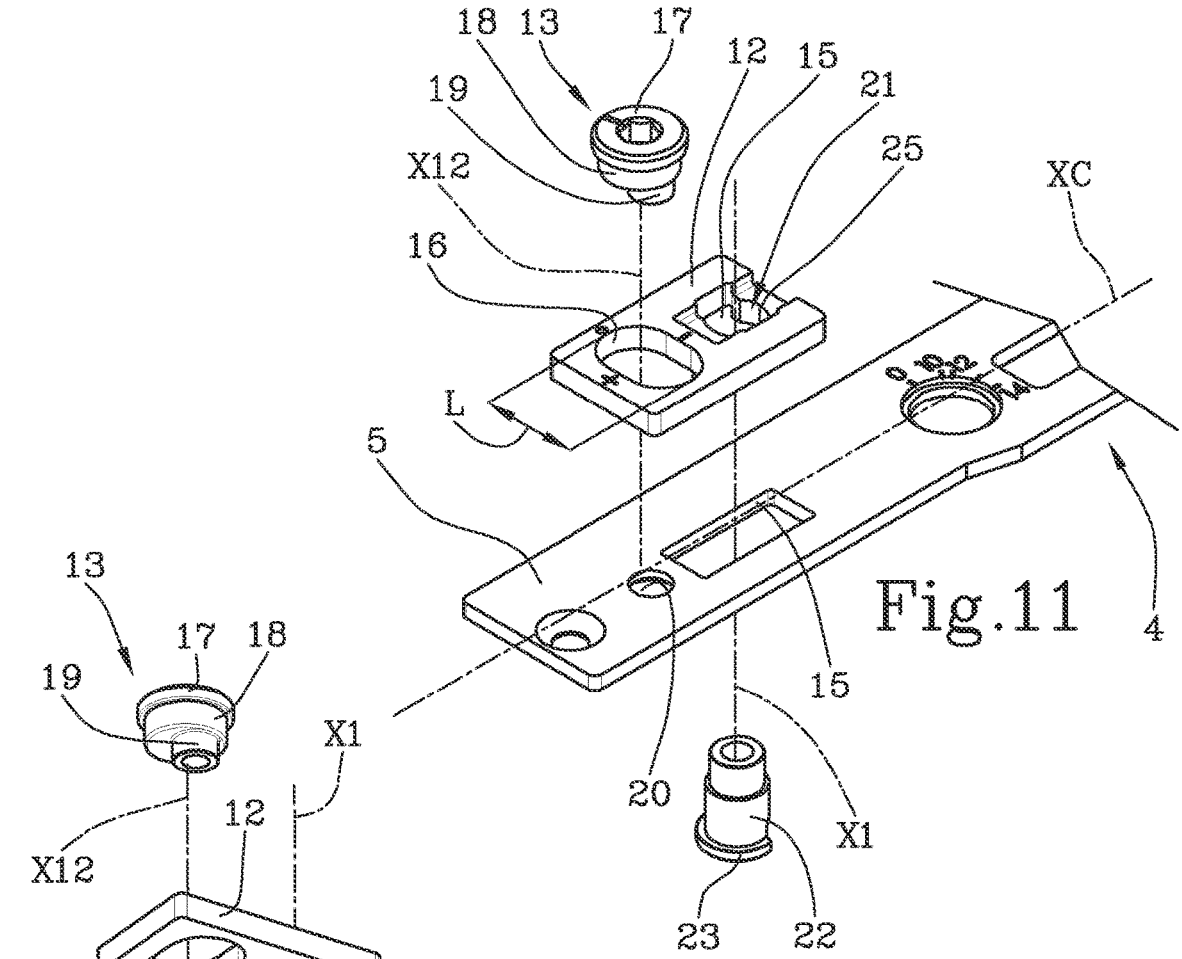
FIGS. 11 and 12 illustrate perspective exploded views from above and below, respectively, of the adjustment means of FIGS. 2 to 4.
Figure 12:
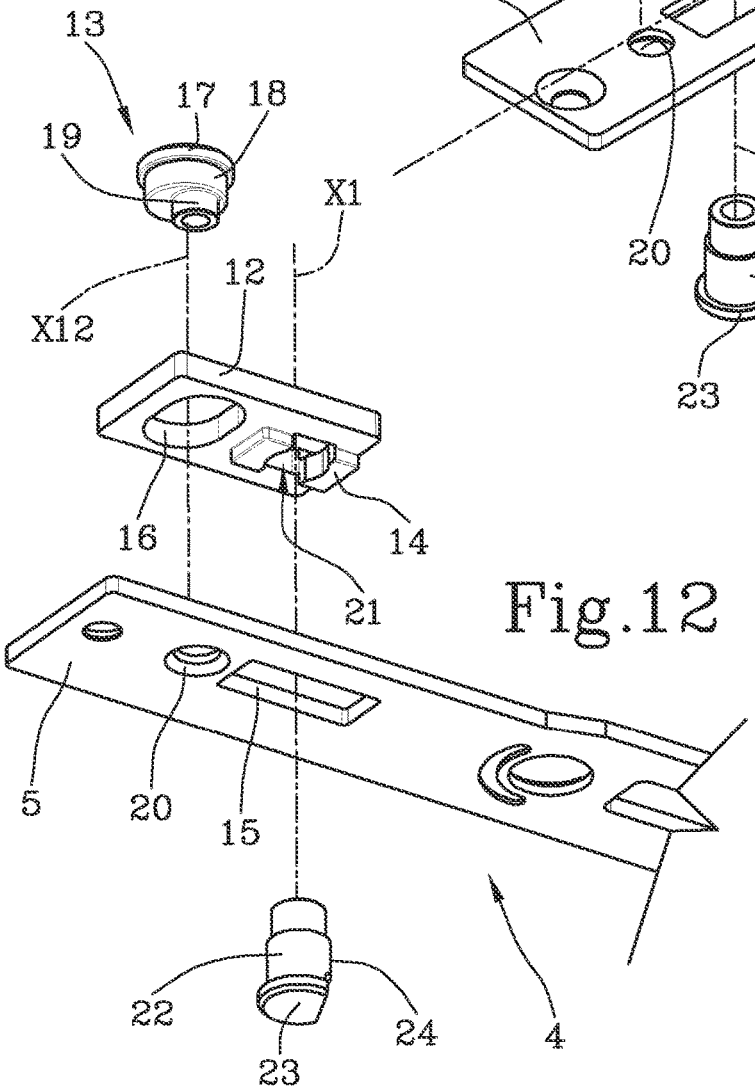

In light of this, the slot 15 has an extension in length parallel to the axis XC of longitudinal extension of the first fixed body 5 in such a way as to constrain the movement of the slide 12 exclusively along the first axis XR1 parallel to the axis XC of longitudinal extension of the first fixed body 5 (see FIGS. 5, 11 and 12).

Preferably, the slide 12 is positioned (is superposed) on the upper surface of the plate forming the first fixed body 5.

In light of this, the projecting body 14 of the slide 12 projects towards the bottom, that is, towards the bottom of the channel 3 of the profile forming the fixed frame 1.

Preferably, a further slot 16 is formed on the second portion of the slide 12, with main length L transversal to the axis XC of longitudinal extension of the first fixed body 5.

In light of this, the rotary element 13 has an eccentric configuration and is positioned inside the further slot 16.

It should be noted that the rotary element 13 is articulated on the first fixed body 5 to form the adjustment axis X12 in such a way as to allow, using a relative rotation, variation of the distance between the adjustment axis X12 and the first axis X1 of articulation.

Figure 2:
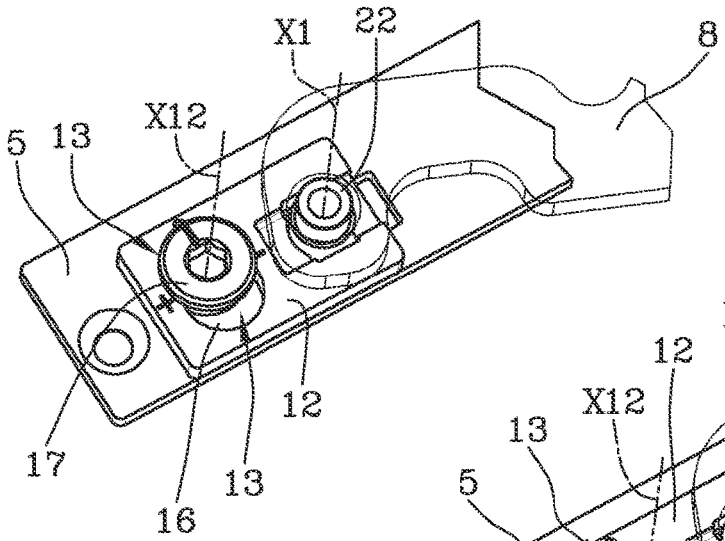
FIGS. 2 to 4 illustrate perspective views from above of a detail A of the hinge of FIG. 1 showing means of adjusting the hinge in three different operating configurations.
Figure 3:
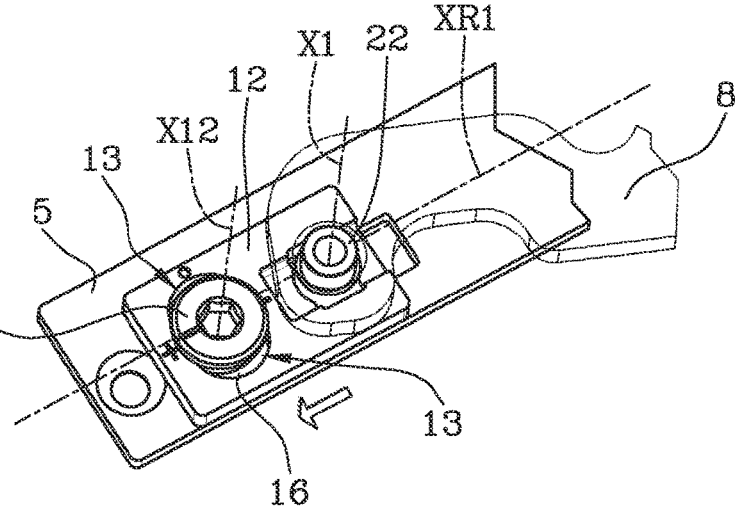
Figure 4:
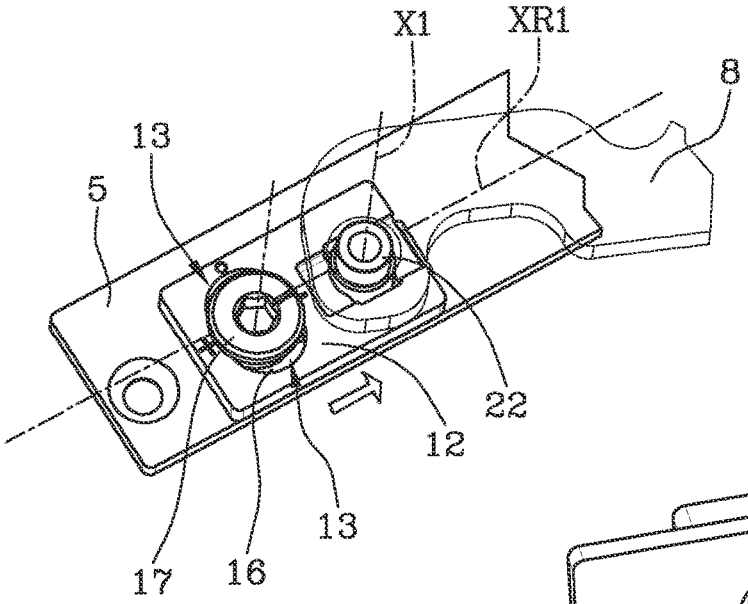

In other words, the rotation of the rotary and eccentric element 13 inside the further slot 16 determines a pushing or pulling action on the slide 12 along the first horizontal axis XR1, whilst the adjustment axis X12 defined by the rotary element 13 moves along a direction perpendicular to the axis XR1 (see FIGS. 2 to 4) thanks to the constraints imparted by the shape of the further slot 16 and by coupling of the projecting body 14 in the slot 15.

Preferably (see FIGS. 6 to 9), the rotary element 13 with an eccentric configuration comprises an upper head 17 protruding from the further slot 16, an intermediate cylindrical operating body 18, integral with the upper head 17, and in contact with the inner surfaces of the further slot 16 and a lower pin 19 articulated inside a hole 20 of the first fixed body 5.

In light of this, the lower pin 19 is integral with the intermediate operating body 18 along an axis which is eccentric relative to the central axis of the intermediate cylindrical operating body 18.

The second portion of the slide 12 has the projecting body 14 on which there is a seat 21 for housing a cylindrical pin 22 for stable articulation between the slide 12 and the first lever 8.

The pin 22 has a lower retaining head 23 equipped with a portion flattened radially to define a flat surface 24.

In light of this, the projecting body 14 has the seat 21 for housing the pin 22 comprising two lateral widenings 25 facing each other defining a corresponding guide surface for the flat surface 24 of the pin 22 allowing a movement of inclination of the first lever 8, that is to say, of a first axis X1 of articulation at a position of the flat surface 24 facing one of the two widenings 12 (see FIGS. 5, 11 and 12).

In other words, the pin 22 (associated with the end of the first lever 8) rotates about the first axis X1 of articulation and, in a position of the movable sash 2 close to the fixed frame 1, has the flat surface 24 facing one of the two widenings 25 in such a way as to create a space or "clearance" inside the seat 21 of the slide 12 which is able to allow an inclination of the pin 22 and, therefore, the first lever 8.

Preferably, the hinge 4 comprises further adjustment means 11 interposed between the first end of the second lever 9 articulated inside the slot 6 of the first fixed body 5 and the first fixed body 5 for adjusting the position of the third axis X3 of articulation along the second horizontal axis XR2 perpendicular to the first horizontal axis XR1, in both directions (see FIGS. 1 and from 13 to 18).

In other words, the end of the second lever 9 articulated to the third axis X3 of articulation is used for "compression" adjustment of the movable sash 2 relative to the fixed frame 1.

More in detail, the adjustment is performed directly on the third axis X3 of articulation.

Preferably, the further adjustment means 11 comprise a runner 26 slidably mounted inside the slot 6 of the first fixed body 5 (on the lower surface of the plate constituting the first fixed body) and an eccentric unit 27 articulated to the first end of the second lever 9 and, below, rotatably coupled to the runner 26 to define an adjustment axis coinciding with the third axis X3 of articulation.

Figure 14:
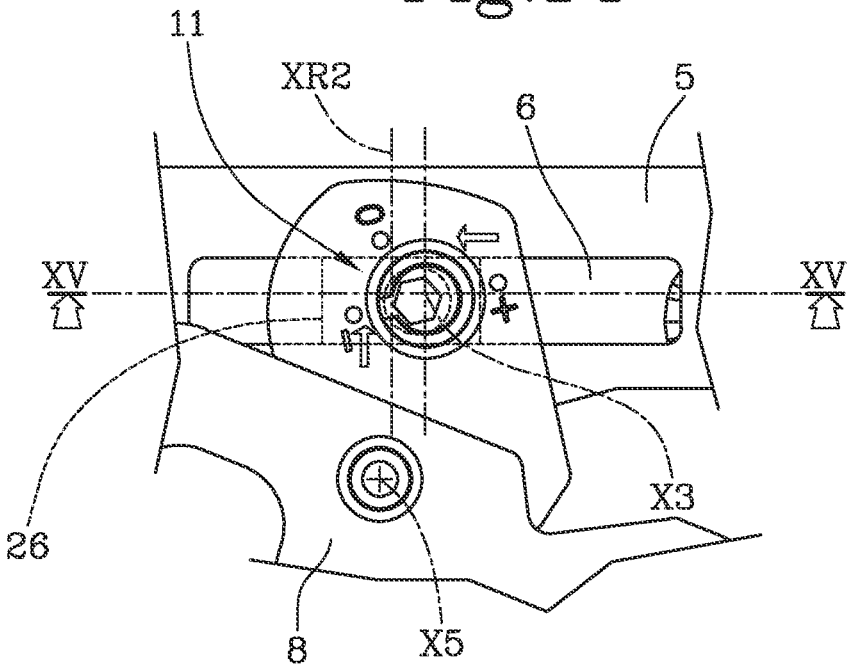
FIG. 14 illustrates a plan view from above of the detail B referred to FIG. 1 in a first operating configuration.
Figure 16:
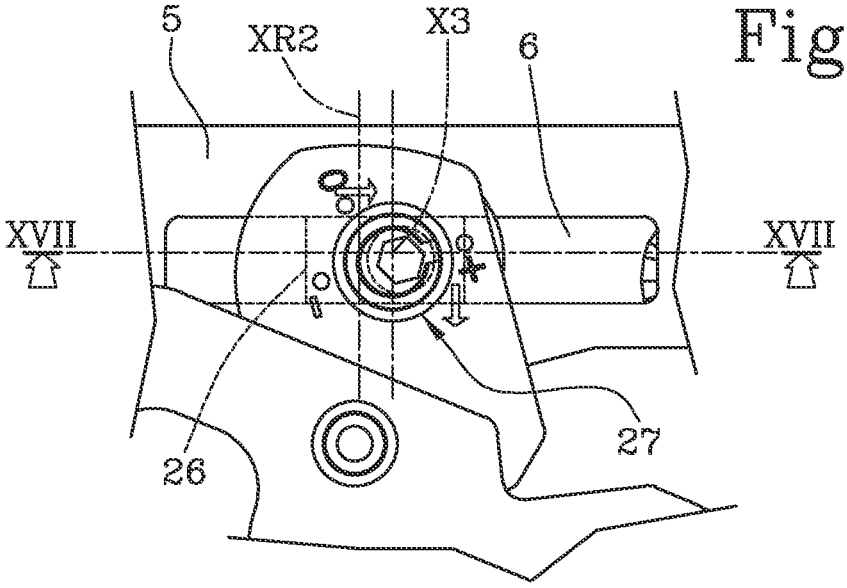
FIG. 16 illustrates a plan view from above of the detail B referred to FIG. 1 in a second operating configuration.
Figure 17:
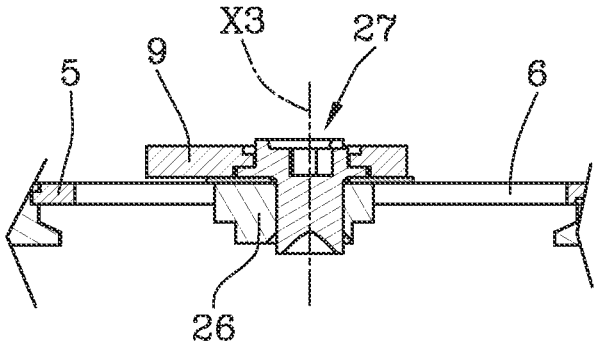
FIG. 17 illustrates a cross section through line XVII-XVII of FIG. 16.

Preferably, the eccentric unit 27 being configured for adjusting the third axis X3 of articulation using a relative rotation about the adjustment axis which is able to move, in both directions, the end of the second lever 9 along the second horizontal axis XR2 simultaneously with a corresponding compensation translation of the runner 26 along the slot 6 of the first fixed body 5 (see in particular FIGS. 14 and 16).

Thanks to this combination of components, the runner 26 keeps the third axis X3 of articulation along the axis XC of longitudinal extension of the first fixed body 5 (thanks to the compensation sliding), whilst the second lever 9 (therefore, the movable body 2) may be adjusted along the second axis XR2 for adjusting the fixed frame 1-movable sash 2 compression. Preferably, the eccentric unit 27 comprises an upper cylindrical head 28 of articulation to the first end of the second lever 9 (having a through seat 9*a*) and a lower pin 29, axially eccentric relative to the cylindrical head 28, coupled stably in a seat 30 made on the runner 26.

Therefore, the rotation of the head 28 inside the seat 9*a* creates both a movement of the second lever 9 along the second horizontal axis XR2 combined with the movement of the runner 26 along the slot 6 according to a trajectory parallel to the axis XC of longitudinal extension of the first fixed body 5.

It should also be noted that the runner 26 has an asymmetric shape, in cross section, obtained from a protruding lower side wall 26*a*, parallel to the extension of the slot 6, forming an undercut for retaining the runner 26 between the first fixed body 5 and the fixed frame 1.

Figure 13A:
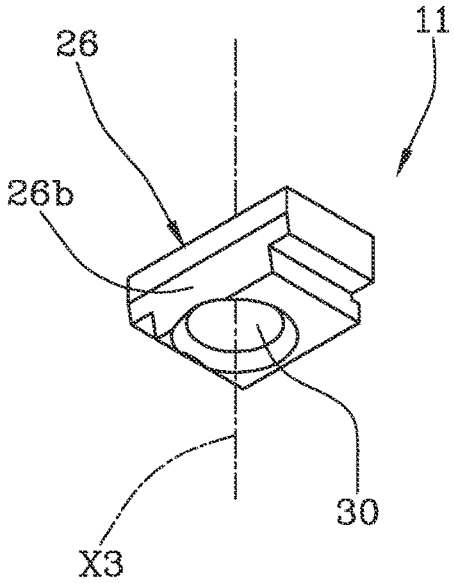
FIG. 13*a* illustrates a perspective view of a component relative to FIG. 13, that is, a runner.
Figure 13:
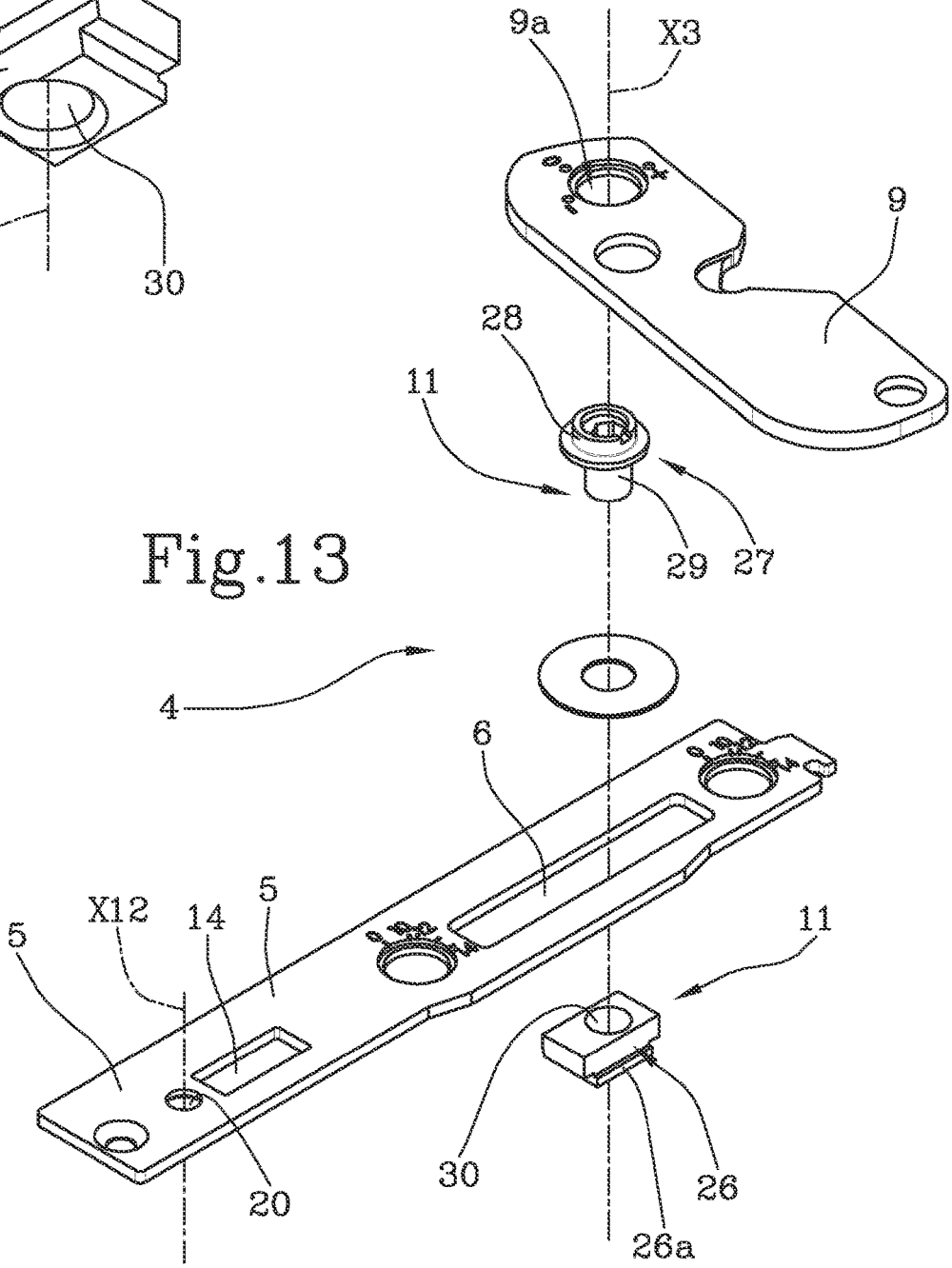
FIG. 13 illustrates an exploded view, with some parts cut away in order to better illustrate others, of a detail B referred to FIG. 1.
Figure 15:
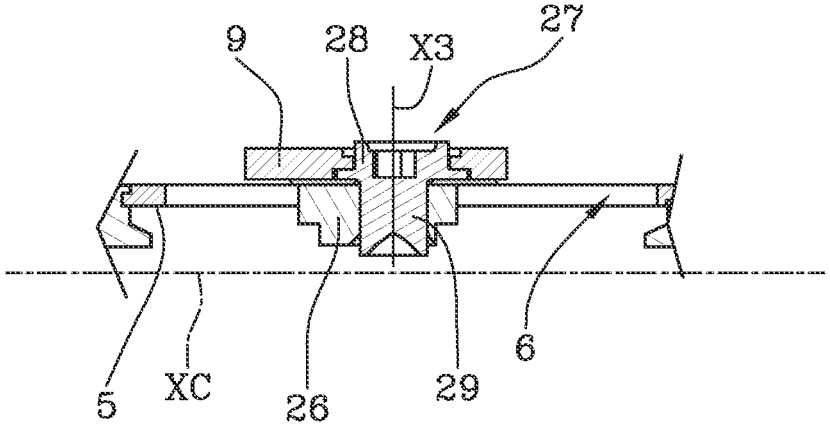
FIG. 15 illustrates a cross section through line XV-XV of FIG. 14.
Figure 18:
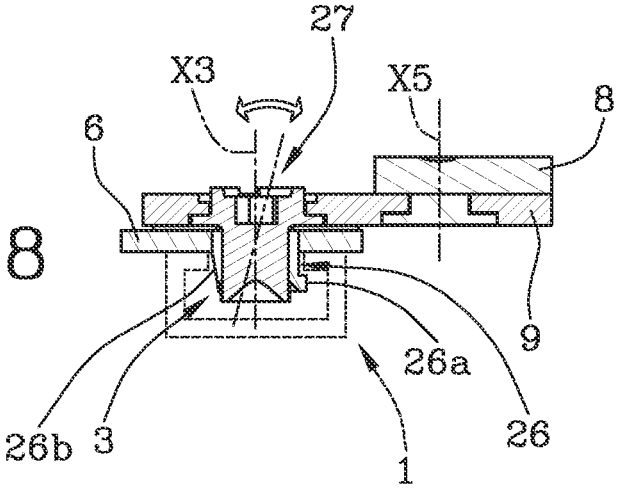
FIG. 18 illustrates a front view, with some parts cut away, of the detail B.

On the opposite side of the runner 26 there is a flat wall 26*b* tapered downwardly towards the centre of the runner 26 which is capable of allowing a movement of inclination of the second lever 9 that is, of the third axis X3 of articulation, when required (see in detail FIGS. 13*a* and 18). The preset aims are achieved with a hinge structure in this way.

More specifically, the adjustment means located close to or directly on the articulation axes made on the fixed body allow a fast and precise axial and/or compression adjustment of the sash without complicating the movable supporting part of the hinge.

The separate adjustment units are extremely simple and do not increase the dimensions of the hinge.

The invention claimed is:

1. A hinge for doors or windows comprising a fixed frame (1) and a movable sash (2) formed by section bars having at least one perimeter channel (3); the hinge (4) comprising at least:

a fixed body (5) associated with the fixed frame (1), the fixed body (5) having a first axis (X1) of fixed articulation and a slot (6) made parallel to the axis (XC) of longitudinal extension of the fixed body (5);

a movable body (7) connected to the movable sash (2);

a first lever (8) having a first end articulated to the fixed body (5) about the first axis (X1) of fixed articulation, a second end articulated to the movable body (7), defining a second axis (X2) of articulation, and an intermediate zone;

a second lever (9) having a first end articulated inside the slot (6) of the fixed body (5) to define a third axis (X3) of slidable articulation, a second end articulated to the movable body (7) defining a fourth axis (X4) of articulation and an intermediate zone; the first (8) and second (9) lever being articulated to each other in the corresponding intermediate zone to define a fifth axis (X5) of shared articulation;

adjusting means (10, 11) for adjusting the first axis (X1) of articulation, characterised in that the adjustment means (10) comprise a slide (12) positioned on the fixed body (5) and having a first constraining portion for the first axis (X1) of articulation and a second portion associated with an adjustment axis (X12), parallel to the first axis (X1) of articulation, using a rotary element (13) configured for moving the slide (12) along the first horizontal axis (XR1) parallel to the axis (XC) of longitudinal extension of the fixed body (5), to vary the distance between the adjustment axis (X12) and the first axis (X1) of articulation in both directions along the first horizontal axis (XR1), in both directions; wherein a further slot (16) is formed on the second portion of the slide (12) with main length (L) transversal to the axis (XC) of longitudinal extension of the fixed body (5); the rotary element (13) having an asymmetric configuration and positioned inside the further slot (16); the rotary element (13) being articulated on the fixed body (5) to form the adjustment axis (X12) in such a way as to allow, using a relative rotation, variation of the distance between the adjustment axis (X12) and the first axis (X1) of articulation.

2. The hinge according to claim 1, wherein the first constraining portion of the slide (12) is equipped with a projecting body (14) slidably coupled in a slot (15) formed on the fixed body (5); the slot (15) having a length parallel to the axis (XC) of longitudinal extension of the fixed body (5) in such a way as to constrain the movement of the slide (12) exclusively along the first axis (XR1) parallel to the axis (XC) of longitudinal extension of the fixed body (5).

3. The hinge according to claim 1, wherein the rotary element (13) comprises an upper head (17) protruding from the further slot (16), an intermediate cylindrical operating body (18), integral with the upper head (17), and in contact with the inner surfaces of the further slot (16) and a lower pin (19) articulated inside a hole (20) of the fixed body (5) and integral with the intermediate operating body (18) along an axis eccentric relative to the central axis of the intermediate cylindrical operating body (18).

4. The hinge according to claim 1, wherein the first constraining portion of the slide (12) has a projecting body (14) on which there is a seat (21) for housing a cylindrical pin (22) for articulation between the slide (12) and the first lever (8); the pin (22) having a lower retaining head (23) equipped with a portion flattened radially to define a flat surface (24).

5. The hinge according to claim 4, wherein the projecting body (14) has the housing seat (21) comprising two lateral widenings (25) facing each other defining a corresponding guide surface for the flat surface (24) of the pin (22) allowing a movement of the first axis (X1) of articulation at a position of the flat surface (24) facing one of the two widenings (25).

6. The hinge according to claim 1, comprising further adjustment means (11) interposed between the second lever (9) and the fixed body (5) for adjusting the position of the third axis (X3) of articulation along a second horizontal axis (XR2) perpendicular to the first horizontal axis (XR1) parallel to the axis (XC) of longitudinal extension of the fixed body (5), in both directions.

7. The hinge according to claim 6, wherein the further adjustment means (11) comprise a runner (26) slidably mounted inside the slot (6) of the fixed body (5) and an eccentric unit (27) articulated to the first end of the second lever (9) and, below, rotatably coupled to the runner (26).

8. The hinge according to claim 7, wherein the eccentric unit (27) is configured for adjusting the third axis (X3) of articulation using a relative rotation about the third axis (X3) of articulation which is able to move, in both directions, the end of the second lever (9) along the second horizontal axis (XR2) simultaneously with a corresponding compensation translation of the runner (26) along the slot (6) of the fixed body (5).

9. The hinge according to claim 7, wherein the eccentric unit (27) comprises an upper cylindrical head (28) of articulation to the first end of the second lever (9) and a lower pin (29), axially eccentric relative to the cylindrical head (28), coupled in a seat (30) made on the runner (26).

10. The hinge according to claim 7, wherein the runner (26) has an asymmetric shape obtained from a protruding lower side wall (26*a*), parallel to the extension of the slot (6), forming an undercut for retaining the runner (26) between the fixed body (5) and the fixed frame (1), and, in the opposite side, a flat wall (26*b*) tapered downwardly towards the centre of the runner (26) which is capable of allowing a movement of the third axis (X3) of articulation, when required.

11. The hinge according to claim 1, comprising a connecting rod (31) having a first end and a second end; the connecting rod (31) being interposed and articulated, at its first end to the second end of the second lever (9) and, at its second end, to the movable body (7).

* * * * *